US007062876B2

(12) United States Patent
Wilson

(10) Patent No.: US 7,062,876 B2
(45) Date of Patent: Jun. 20, 2006

(54) RIFLE SCOPE MOUNTING MEANS

(76) Inventor: Brett Wilson, 2405 Alexandra La., Cedar Park, TX (US) 78613

( * ) Notice: Subject to any disclaimer, the term of this patent is extended or adjusted under 35 U.S.C. 154(b) by 57 days.

(21) Appl. No.: 10/790,408

(22) Filed: Mar. 2, 2004

(65) Prior Publication Data

US 2005/0039369 A1 Feb. 24, 2005

Related U.S. Application Data

(60) Provisional application No. 60/492,658, filed on Aug. 6, 2003.

(51) Int. Cl.
*F41G 1/387* (2006.01)

(52) U.S. Cl. ..... 42/125; 42/138

(58) Field of Classification Search ..... 42/135, 42/136, 138, 140, 148, 124, 125, 126, 127, 42/128

See application file for complete search history.

(56) References Cited

U.S. PATENT DOCUMENTS

| | | | | |
|---|---|---|---|---|
| 3,187,435 A * | 6/1965 | Miller, Jr. | ..... | 42/126 |
| 3,414,221 A * | 12/1968 | Nelson | ..... | 42/126 |
| 3,513,549 A | 5/1970 | Smiley | ..... | 33/50 |
| 4,418,487 A | 12/1983 | Strahan | ..... | 42/1 ST |
| 4,455,776 A | 6/1984 | Ashley et al. | ..... | 42/1 ST |
| 4,845,871 A | 7/1989 | Swan | ..... | 42/101 |
| 4,890,407 A | 1/1990 | Nichols | ..... | 42/100 |
| 4,899,479 A * | 2/1990 | Sanders | ..... | 42/112 |
| 5,134,798 A | 8/1992 | Lee | ..... | 42/100 |
| 5,274,941 A * | 1/1994 | Moore | ..... | 42/126 |
| 5,343,650 A | 9/1994 | Swan | ..... | 42/100 |
| D367,312 S | 2/1996 | Martel | ..... | D22/110 |
| 5,522,166 A | 6/1996 | Martel | ..... | 42/101 |
| 5,806,228 A | 9/1998 | Martel et al. | ..... | 42/101 |
| 5,956,190 A * | 9/1999 | Sieg | ..... | 359/827 |

* cited by examiner

*Primary Examiner*—Stephen M. Johnson
(74) *Attorney, Agent, or Firm*—Christopher J. Whewell

(57) ABSTRACT

Provided herein is a sight base useful to render military-style rifles equipped with battle sights to be retrofitted with telescopic rifle scopes. Use of a device according to the invention provides sporting use and accuracy to rifles originally conceived as weapons of war, in a quick and convenient method. A sight base according to the invention is readily attached and detached from a rifle, and provides surprising accuracy owing to the rigid means by which a scope may be affixed to a rifle through use of the scope base provided herein.

3 Claims, 10 Drawing Sheets

RIFLE SCOPE MOUNTING MEANS

CROSS-REFERENCE TO RELATED APPLICATIONS

This application claims the benefit of U.S. Provisional Application Ser. No. 60/492,658, filed Aug. 6, 2003, which application is incorporated herein by reference in its entirety.

TECHNICAL FIELD

This invention relates to a means for attaching a telescopic or other sighting means, such as red dot sights, to a rifle. More particularly, the present invention provides a device for retrofitting rifles originally equipped with open field sights, or "battle sights" with telescopic scope or other sighting device means known to those skilled in the art to enhance the aiming capabilities of a user of such firearm.

BACKGROUND

There are many firearms which are imported into the United States each year which are of foreign origin. Owing to low labor costs in countries foreign to the United States, the production costs for a given firearm may be significantly lower than similar arms produced within the United States. For the consumer, this translates to the readily-availability of a number of firearms at a reduced cost with respect to their counterparts which are manufactured within the United States.

One firearm which has become popular among firearms enthusiasts is known as the SKS rifle. The SKS is well-known in the art to be a fun and inexpensive rifle which is easy to use, shoot, and clean. It is chambered for a 7.62×39 mm round, which is a low-cost ammunition round. All of these factors make the rifle a great choice for everything from plinking to hunting. However, the SKS rifle has one major downside; it is not provided with a suitable location for mounting a rifle scope. This is probably due to the initial design of the rifle being primarily a weapon of warfare, as opposed to having been designed for sport and hunting purposes.

There have been products on the market which have attempted to solve the problem of the lack of means for affixing a scope to the SKS. One method by which this has been attempted by workers in the prior art is by mounting a weaver-type rail on the receiver cover. The drawback of this approach is that the receiver cover is not directly fixed to the barrel itself, and as such accuracy is marginal at best. In addition, the receiver cover has to be removed for cleaning, which causes additional loss of zero. There is a new product for a similar firearm that attempts to clamp a weaver rail to the gas tube and barrel. This setup also has problems, as the barrel heats up a shift in zero occurs owing to the expansion of the metal parts, and the unit must also be removed to clean the gas tube and port. Various other workers have provided means for attaching various sight means to rifles, a few of which are not outlined below.

U.S. Pat. No. 3,513,549 discloses a sight mount and sight mount bar for mounting a telescopic sight on a firearm such as a rifle. The mounting comprises a bar which has a swivel attachment at an intermediate point to a mounting post, which post has a dovetail foot or tenon which secures to the transverse dovetail groove in the rifle normally occupied by a sight. The bar can move angularly around the mounting post during installation so that it aligns itself with the rifle barrel after which it is clamped the mounting bar provides a means for adjusting it at its ends so that its axis can be tilted angularly relative to the axis of the bore for adjusting the telescope axis in this plane.

U.S. Pat. No. 4,418,487 teaches a mounting bracket for mounting a scope-type sight on a handgun, the handgun having a frame, a barrel supported on the frame, a handle disposed angularly relative to the barrel remote from the discharge end of the barrel. The frame includes a trigger guard disposed about a trigger spaced below the barrel adjacent the handle. The bracket comprises a substantially rectangular housing having a channel extending longitudinally therethrough from a first end to a second end to define a spaced pair of side walls, a top wall and a bottom wall. The channel is of a size for receiving at least the barrel and a portion of the frame, and the top wall includes a planar exterior surface for supporting the sight. The bottom wall extends from the first end of the housing and has a terminus spaced from the second end. The bottom wall includes an interior surface having a shape conforming substantially to that of the frame adjacent the trigger guard. Each side wall havs a bore intermediate the terminus and the second end. The bore in one side wall is aligned with the bore in the other side wall for receiving a pin extending from one bore to the other. There is a protuberance disposed on the exterior surface of the bottom wall which has a terminal surface substantially at the terminus. There is an adjustable stop means carried by the protuberance for extension from the terminal surface, whereby the mounting bracket may be supported on the frame by positioning the pin through the frame and securing the stop means against the trigger guard.

U.S. Pat. No. 4,455,776 provides a sight mount for a firearm having a receiver with an ejection port for expulsion of spent shells therefrom, and a stock to carry a barrel. The mount includes a U-shaped body having first and second leg means extending outwardly therefrom in a generally parallel spaced relation, so that one leg is received on either side of the receiver. The legs have at least one aligned aperture adjacent the lower edge thereof for attachment to the receiver. The first leg of the mount has notch means to expose the ejection port of the receiver and a second notch to receive a pin carried by a bolt provided in the receiver.

U.S. Pat. No. 4,845,871 sets forth a fastening device comprising a locking means and an actuating means. The locking means includes a base portion and a shaft, and the base portion has an upper surface and the shaft centrally positioned on the upper surface in right angle relation thereto. There is a ring which extends from the upper surface in circumscribing, abutting relationship to the shaft. The shaft includes a free terminal end and an opening being transversely formed through the shaft in close proximity to the terminal end. The upper surface of the locking means includes a first camming area and a second camming area spaced from the first camming area. The actuating means includes a base having a top surface, a bottom surface and a centrally positioned aperture formed therethrough, and a tubular portion extending from the top surface in coaxial relation to the aperture and in right angle relation to the top surface. A hole is formed transversely through the tubular portion in right angle relation thereto. The tubular portion includes an external surface from which a handle extends. The fastening device is adapted to engage a support wherein the support has a platform means extending therefrom, in which the platform means includes a support base having a first aperture formed therethrough. The first aperture includes an internal shoulder. The support base includes an uppermost surface and a lowermost surface and the shaft of the locking means passes through the first aperture of the support positioning the ring of the locking means within the first aperture and the upper surface of the base portion in abutting relation to the lowermost surface of the support. The shaft of the locking means is positioned in the tubular portion of the actuating means with the actuating means engaged to the locking means.

U.S. Pat. No. 4,890,407 describes a sight mount for a firearm, comprising: a) an elongated first member; b) an elongated second member; c) a fastening means for adjustably fastening the first member to the second member to form the mount, wherein fastened together, the first and second members define a dovetail sight mount at a top region thereof and further define a clamping attachment portion at a bottom region thereof. The clamping attachment portion is sized to receive a portion of the firearm and clamp the mount thereto. There is also a a rear thrust member extending through the mount and contacting the firearm.

U.S. Pat. No. 5,134,798 discloses an improvement in a sight mount of the type comprising an elongated base bar having a forward end, a rearward end, an upper sight receiving portion and a lower mounting portion, a clamping guide on the upper sight receiving portion, a see-through center hole having an axis parallel to the longitudinal axis of the elongated base bar and located between the upper sight receiving portion and the lower mounting portion, and a self-aligning v-guide having a mounting hole on the lower mounting portion for mounting the sight on a firearm. The improvement comprises: a) an auxiliary sight base bar having an upper surface, a forward end and a rearward end; b) the rearward end of the auxiliary sight base bar being rigidly attached to the forward end of the elongated base bar such that the upper surface is in line with and parallel to the elongated base bar and also spaced at a distance below the see-through center hole of the elongated base bar, and c) the auxiliary sight base bar further comprising a clamping guide on the upper surface thereof.

U.S. Pat. No. 5,522,166 teaches a sighting device mount for securing a sighting device to a receiver assembly of a rifle comprising: a) a replacement receiver cover adapted to be secured to the receiver assembly to enclose at least a portion of the interior of the receiver assembly; b) a sighting device mounting structure integrally formed on the replacement receiver cover; and c) a pair of longitudinal side rails extending from opposite sides of the replacement receiver cover for contacting the receiver assembly and thereby reducing movement of the replacement receiver cover relative to the receiver assembly.

U.S. Pat. No. 5,343,650 provides an extended rigid frame receiver sleeve for interfacing integrated and modular enhancements to a firearm having forward and rearward portions, wherein the firearm has minimally a receiver with a stock and barrel attached thereto. The barrel defines the forward portion of the firearm and the stock defines the rearward portion of the firearm. The firearm longitudinal axis is defined as horizontal and running from the stock through the receiver to the barrel. The receiver is comprised of an upper receiver and a lower receiver, in which the upper receiver has a forward portion, a top and a rearward portion, wherein the barrel is joined to the forward portion of the upper receiver. The sleeve comprises: a) a forward interface portion having sides, a front and a rear; and b) a rearward interface portion, having sides comprised of: i) a fixed receiver interface sleeve element joined to the top of the upper receiver and having a front joined to the rear of the forward interface portion; and ii) a slidable sleeve element slidably mounted on the fixed receiver interface sleeve element.

U.S. Pat. No. 5,806,228 sets forth an improved scope mounting base for a carrying handle on an M-16 type rifle, wherein the carrying handle has a sight tunnel, comprising a scope mounting base adapted to be assembled to the underside of the carrying handle to provide a scope mounting surface on an exterior side surface of the carrying handle in a manner which leaves the sight tunnel through the carrying handle unobstructed by the base, wherein the exterior scope mounting surface comprises a dovetail-type rail surface.

SUMMARY OF THE INVENTION

A scope mounting means according to the present invention consists of two pieces, the sight base and the scope mount. The sight base is a piece which is pinned to the receiver of the rifle and is held in position by four set screws in a preferred form of the invention. Additionally, to the four screws used to mount the base to the receiver, there are an additional four set screws that are used to lock the scope mount into place. The scope mount consists of a standard ⅝" rail with two pins protruding from its lower surface which connectively engage with holes provided in the top surface of the sight base.

The end result of the present invention is a scope mount that replaces the rear battle sight of the SKS rifle. A scope mounting means according to the invention takes advantage of the design of the weapon by using the same structures to secure the scope mount to the rifle that held the original battle sight in place. As a result, the scope mount is a very rugged mounting platform for shooting optics. Once installed, the mount is firmly secured to the same structures as is the barrel, which provides a great platform for accuracy. A scope mount according to the present invention can be removed from the sight adapter base to allow for cleaning of every area of the firearm and reinstalled afterwards without the loss of zero.

In addition, a scope mount according to the present invention allows the shooter to use as many scopes as desired by the shooter. Individual scopes may be mounted on their own scope mounts and may be removed or installed to the rifle by: 1) loosening the four screws on the base: 2) switching scopes; and 3) re-tightening the screws. This flexibility is useful for cases where it is desirable to shoot with a red dot scope while plinking and quickly switch over to a more traditional scope with cross hairs for deer hunting. The shooter can easily switch between these or any two scope styles as often as desired without losing any accuracy in shooting.

The present invention provides a device useful for retrofitting rifles with a scope mounting means which comprises:

a) a central portion shaped substantially in the form of a rectangular solid, having a top surface, a bottom surface, a right side surface, a left side surface, a front end portion, a rear end portion, and a longest length dimension;

b) a right wing portion attached to the right side surface of the central portion and extending below the bottom surface of the central portion, wherein the right wing portion comprises at least one threaded hole disposed therethrough;

c) a left wing portion attached to the left side surface of the central portion and extending below the bottom surface of the central portion, wherein the left wing portion comprises at least one threaded hole disposed therethrough;

wherein the central portion includes a first and a second hole disposed through its top surface which extend through the bottom surface, which holes are adapted to receive pins of a scope mount, and wherein the front end portion of the central portion further includes a third hole disposed through the right side surface which extends through to the left side surface.

DETAILED DESCRIPTION

Figure 1:
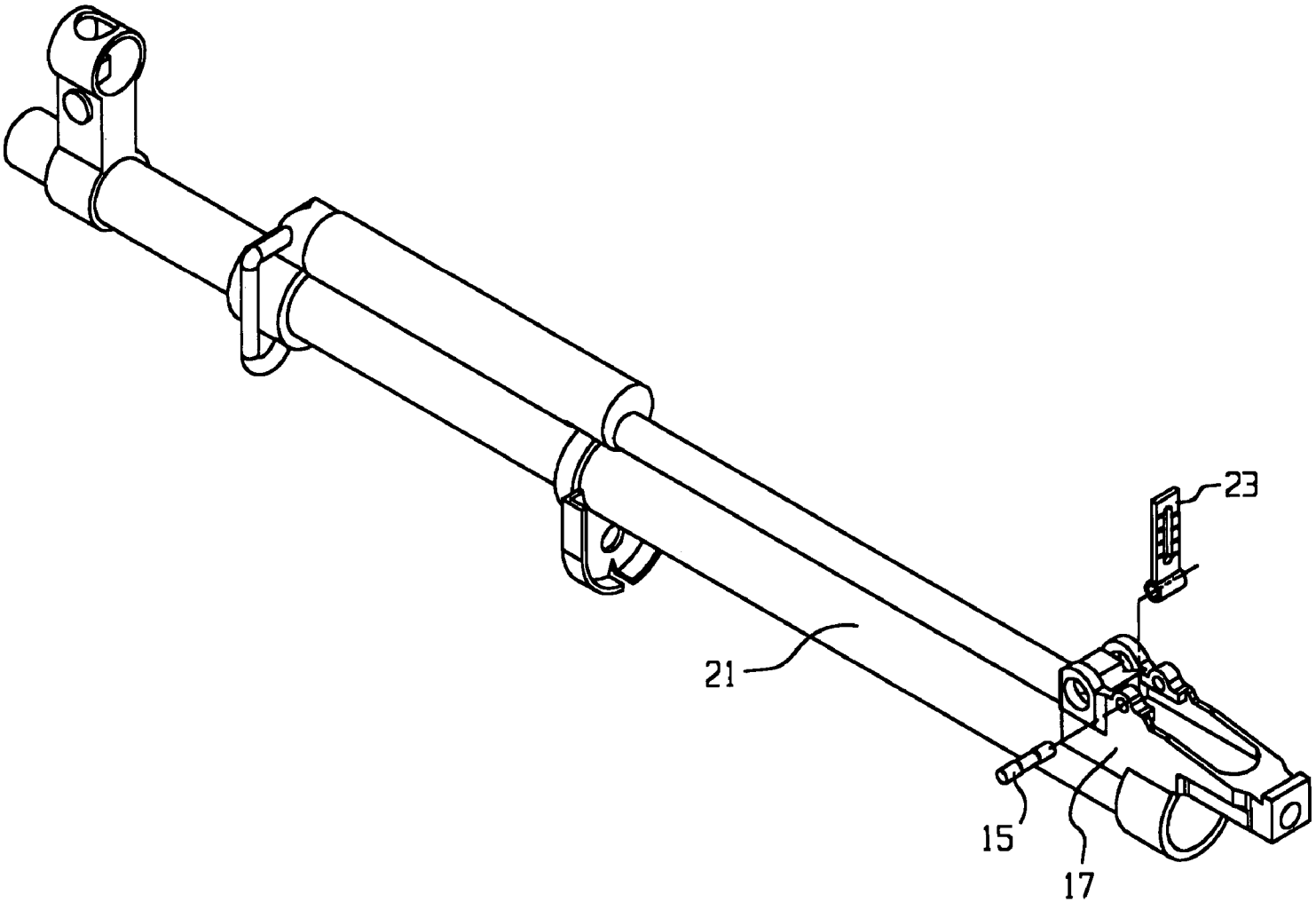
FIG. 1 PRIOR ART
FIG. 1 shows a an exploded perspective view of a rifle barrel according to the prior art.

Referring to the drawings and initially to FIG. 1 there is shown an exploded perspective view of a rifle barrel according to the prior art and comprising what is commonly referred to in the art as a "battle sight" 23, which battle sight is generally attached to a rear battle sight mount 17 by means of a roll pin 15, which is used to firmly secure the battle sight to the rifle. The battle sight 23 can be pivoted about the axis of the roll pin 15 from a horizontal, resting position to a vertical position. It is when the battle sight 23 is placed in its vertical position that it is ready for use, as is well-known in the art.

Figure 2:
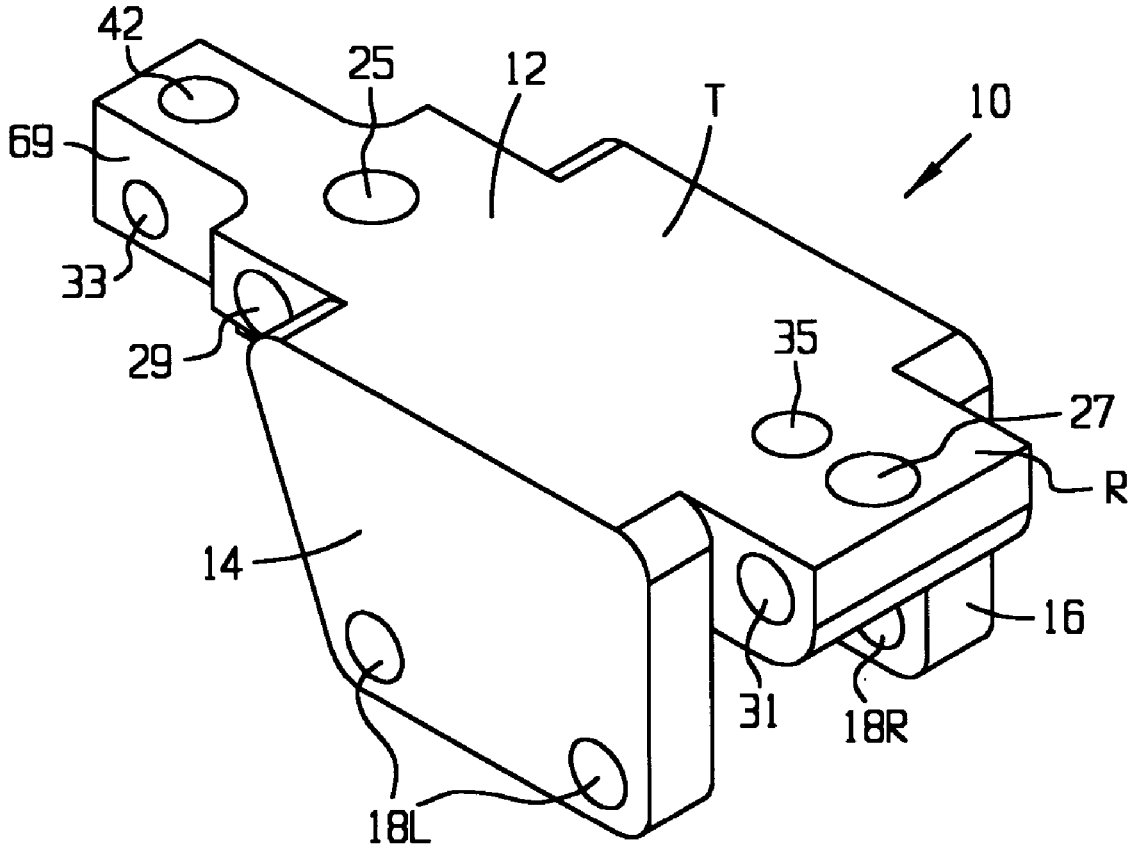
FIG. 2 shows a perspective view of a sight base according to the present invention.

In FIG. 2 there is shown a perspective view of a sight base 10 according to the present invention. Such as sight base 10 comprises a central portion 12, which is provided with a left wing portion 14, and a right wing portion 16, wherein the left and right wing portions extend downwardly from the central portion 12, which central portion is substantially flat in one preferred form of the invention. The left wing portion 14 is provided with a plurality of holes 18L disposed therethrough. Similarly, the right wing portion 16 is provided with a plurality of holes 18R (also see other FIGS) disposed therethrough. The holes 18L and 18R are provided with threads on their inner walls, which render these holes or bores suitable for receiving a set screw of appropriate dimension. Set screws disposed in such bores 18L and 18R are useful for securing the sight base 10 to the rear battle sight mount 17 (see other FIGS) by tightening such set screws. There is also a front scope mounting hole 25 and rear scope mounting hole 27, which are holes disposed through the surface of the central portion 12. Front scope mount lock bore 29 and rear scope mount lock bore 31 are holes whose centerlines are oriented perpendicularly to the centerlines of the bores 25 and 27, respectively. These lock bores as they are conveniently termed, are threaded on their inner wall portions thus rendering them suitable to receive a set screw of appropriate diameter. Their function is to enable a locking attachment of a scope mount according to the invention to the sight base according to the invention by virtue of engagement of set screws disposed in the locking holes against the protruding pins disposed on the underside of the scope mount by tightening the set screws in the bores 29 and 31. There is also an elevation adjustment bore 35 disposed through the central portion, whose walls are threaded to receive a set screw of appropriate dimension, which is useful in adjusting the height of the sight base 10 as a whole in its final, mounted position. Finally, a roll pin receiver hole 33 is provided to permit attachment of the sight base 10 to the rear battle sight mount 17 of a rifle, preferably by means of a roll pin 15 shown in other of the figures. FIG. 2 also shows a threaded bore 42 that is adapted to receive a set screw, which set screw when turned into the bore is capable of exerting a force against a roll pin 15 disposed through the roll pin receiver hole 33. FIG. 2 also shows the front end portion 69 of the sight base 10. FIG. 2 also shows the top surface T and rear end portion R of the central portion 12.

Figure 3:
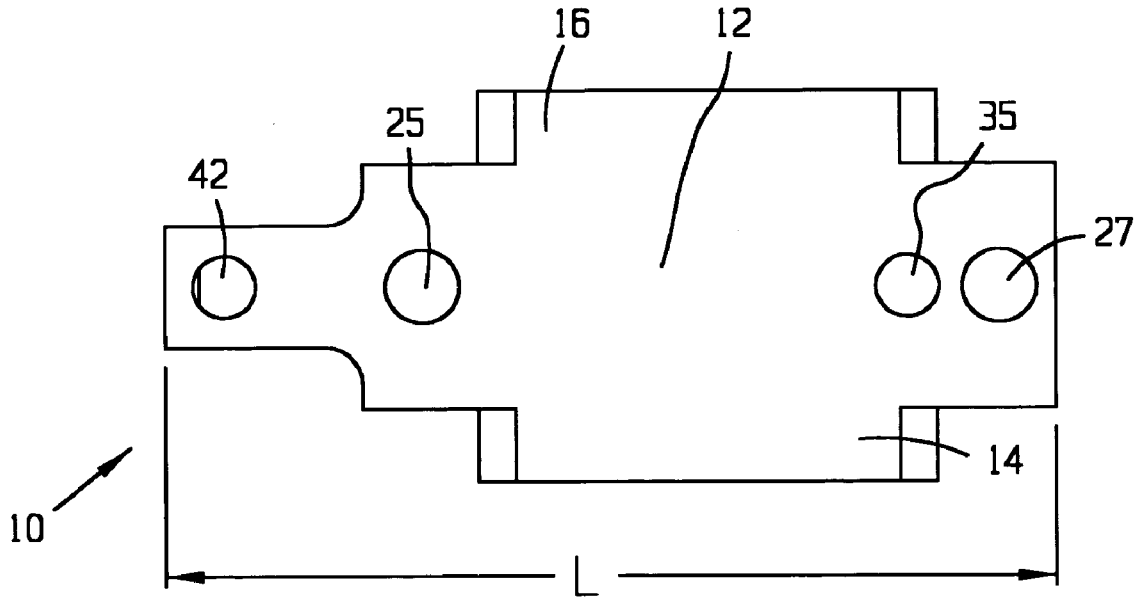
FIG. 3 shows an overhead view of a sight base according to the present invention.

FIG. 3 is an overhead view of a sight base 10 according to the present invention showing the respective positions of central portion 12, the left wing 14, right wing 16, front scope mount receiving hole 25, rear scope mount receiving hole 27, elevation adjustment bore 35, and threaded bore 42. FIG. 3 also shows the longest length dimension L of a sight base 10 according to the invention.

Figure 4:
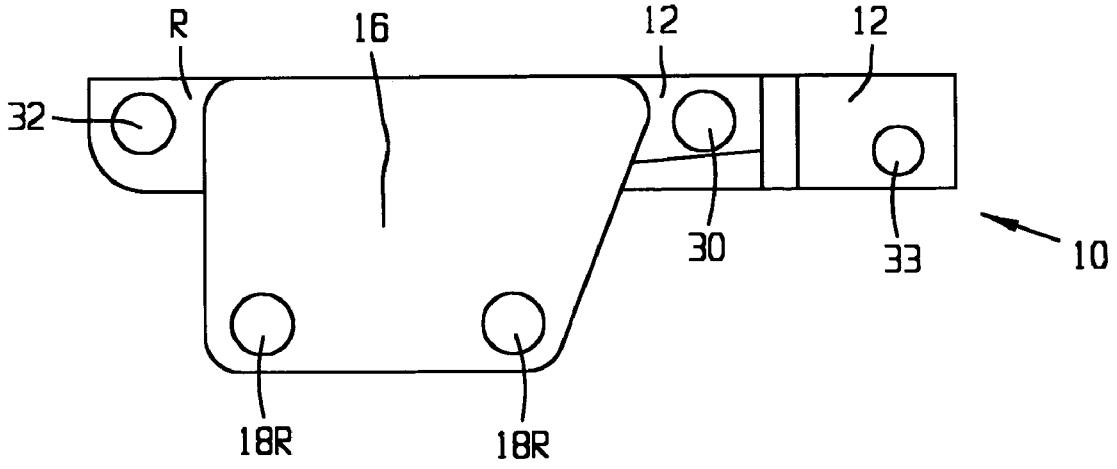
FIG. 4 shows an right side view of a sight base according to the present invention.

FIG. 4 is a right side view of a sight base 10 according to the invention showing the respective positions of the central portion 12, right wing portion 16, and holes 18R. There is a front scope mount lock bore 30 and rear scope mount lock bore 32, which are holes whose centerlines are oriented perpendicularly to the centerlines of the bores 25 and 27, respectively, and the front scope mount lock bore 30 and rear scope mount lock bore 32 are analogous in their function and location to the front scope mount lock bore 29 and rear scope mount lock bore 31 from FIG. 2, as the sight base 10 is symmetrical about the center of its longest dimension. The right side surface of the central portion 12 is denoted by R.

Figure 5:
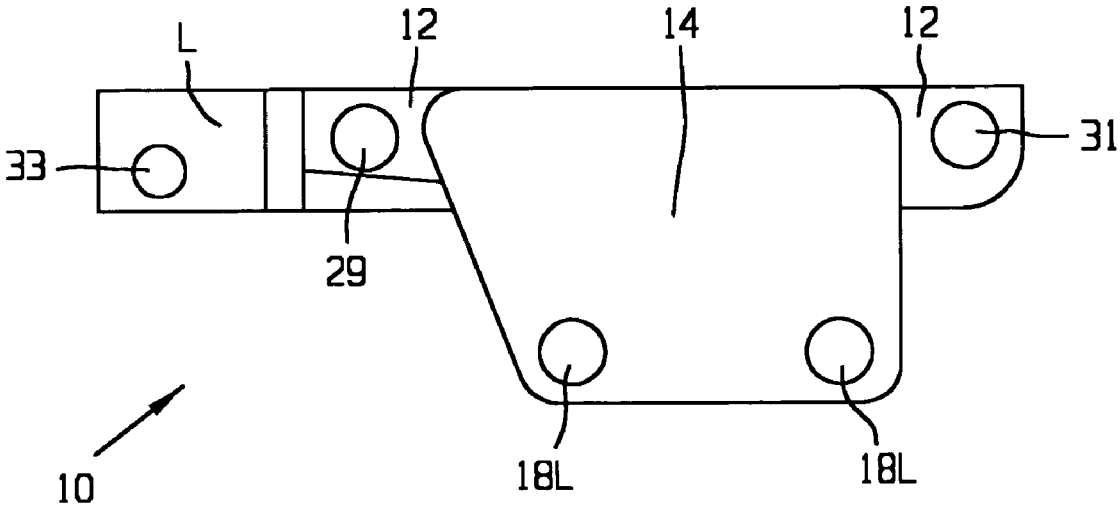
FIG. 5 shows an left side view of a sight base according to the present invention.

FIG. 5 is a left side view of a sight base 10 according to the invention showing the respective positions of the central portion 12, left wing portion 14, and holes 18L. There is a front scope mount lock bore 29 and rear scope mount lock bore 31, which are holes whose centerlines are oriented perpendicularly to the centerlines of the bores 25 and 27 (FIG. 2), respectively. The left side surface of the central portion 12 is denoted by L.

Figure 6:
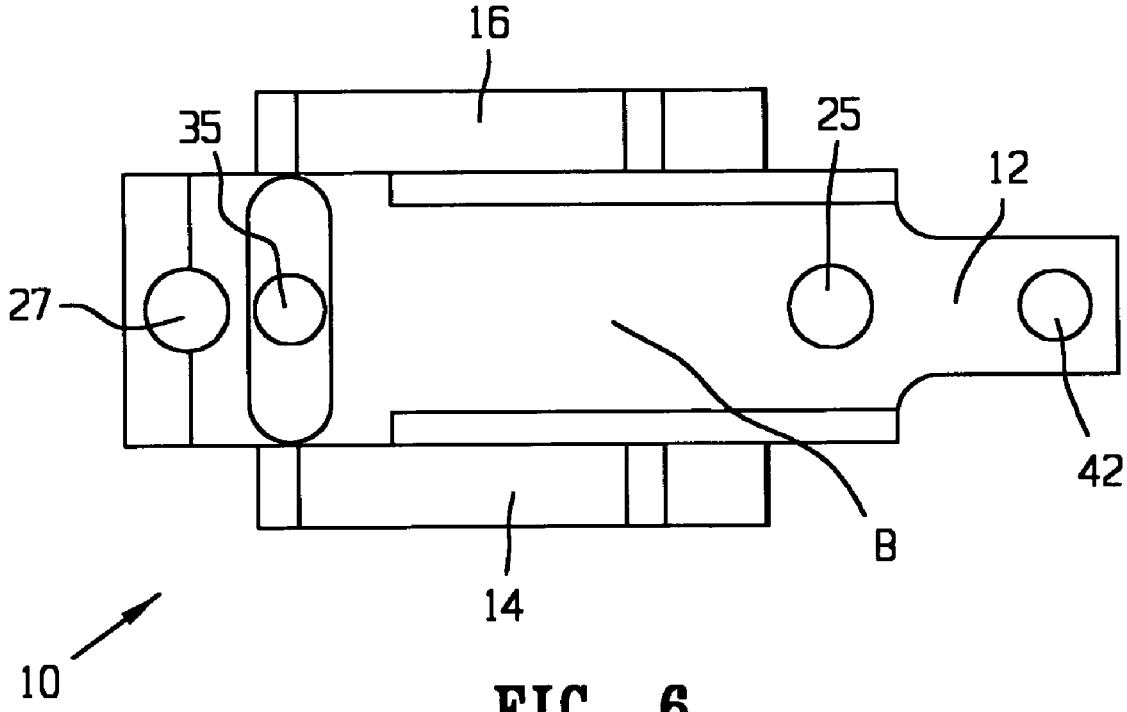
FIG. 6 shows a bottom view of a sight base according to the present invention.

FIG. 6 is a bottom view of a sight base 10 according to the invention showing the respective positions of the left wing portion 14, right wing portion 16, central portion 12, threaded hole 42, front scope mount receiving hole 25, rear scope mount receiving hole 27 and elevation adjustment bore 35. The bottom surface B of the central portion 12 is also shown.

Figure 7:
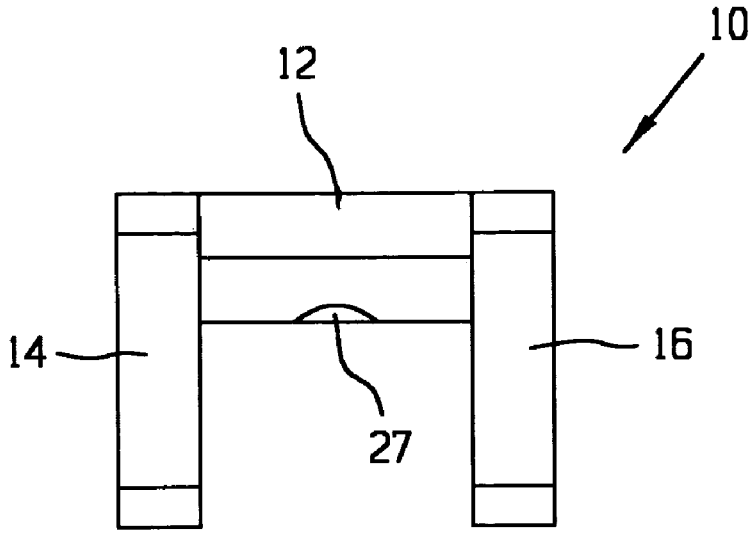
FIG. 7 shows a rear end view of a sight base according to the present invention.

FIG. 7 shows a rear end view of a sight base 10 according to the present invention, and the respective positions of the central portion 12, left wing portion 14, and right wing portion 16. A portion of the rear scope mount receiving hole 27 is also visible in this view.

Figure 8:
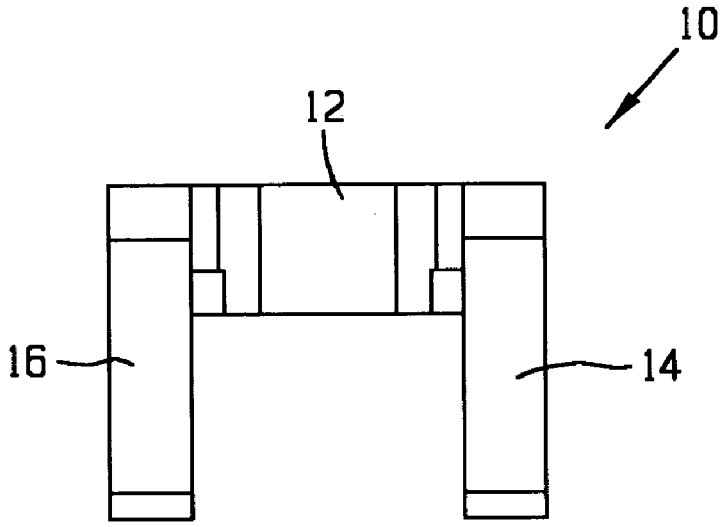
FIG. 8 shows a front end view of a sight base according to the present invention.

FIG. 8 shows a front end view of a sight base 10 according to the present invention, and the respective positions of the central portion 12, left wing portion 14, and right wing portion 16.

Figure 9:
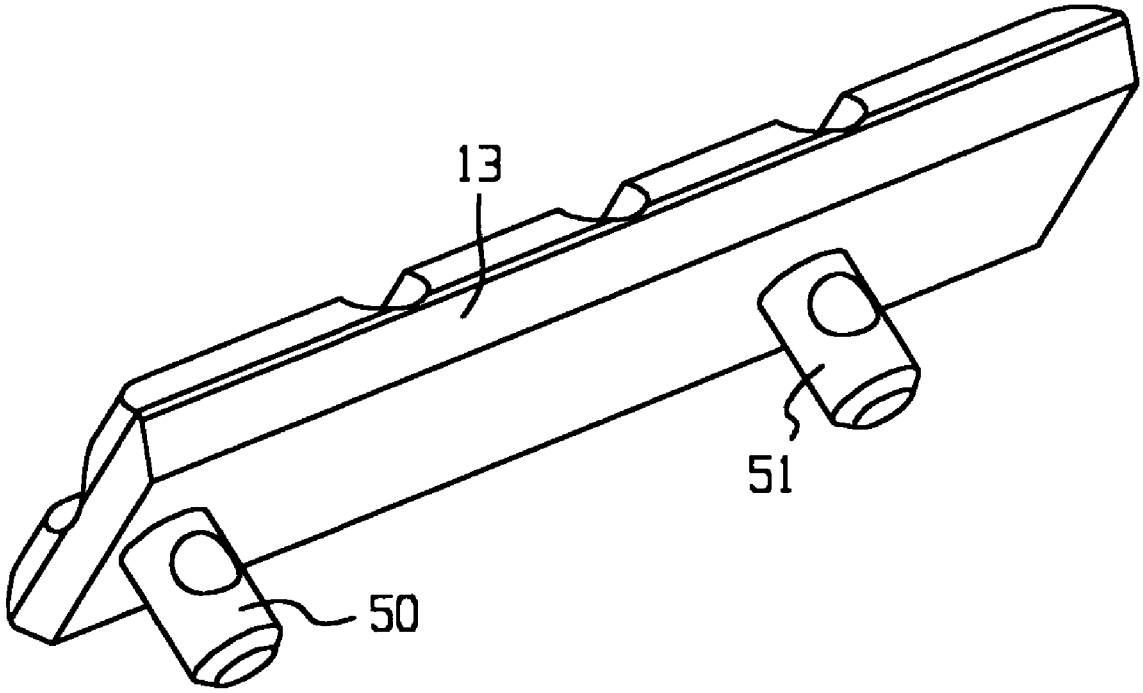
FIG.9 (PRIOR ART)
FIG. 9 shows a side perspective view of a scope mount of the prior art useful in accordance with the present invention.

FIG. 9 shows a side perspective view of a scope mount 13 useful in accordance with the present invention, having pins 50 and 51 protruding from its bottom surface.

Figure 10:
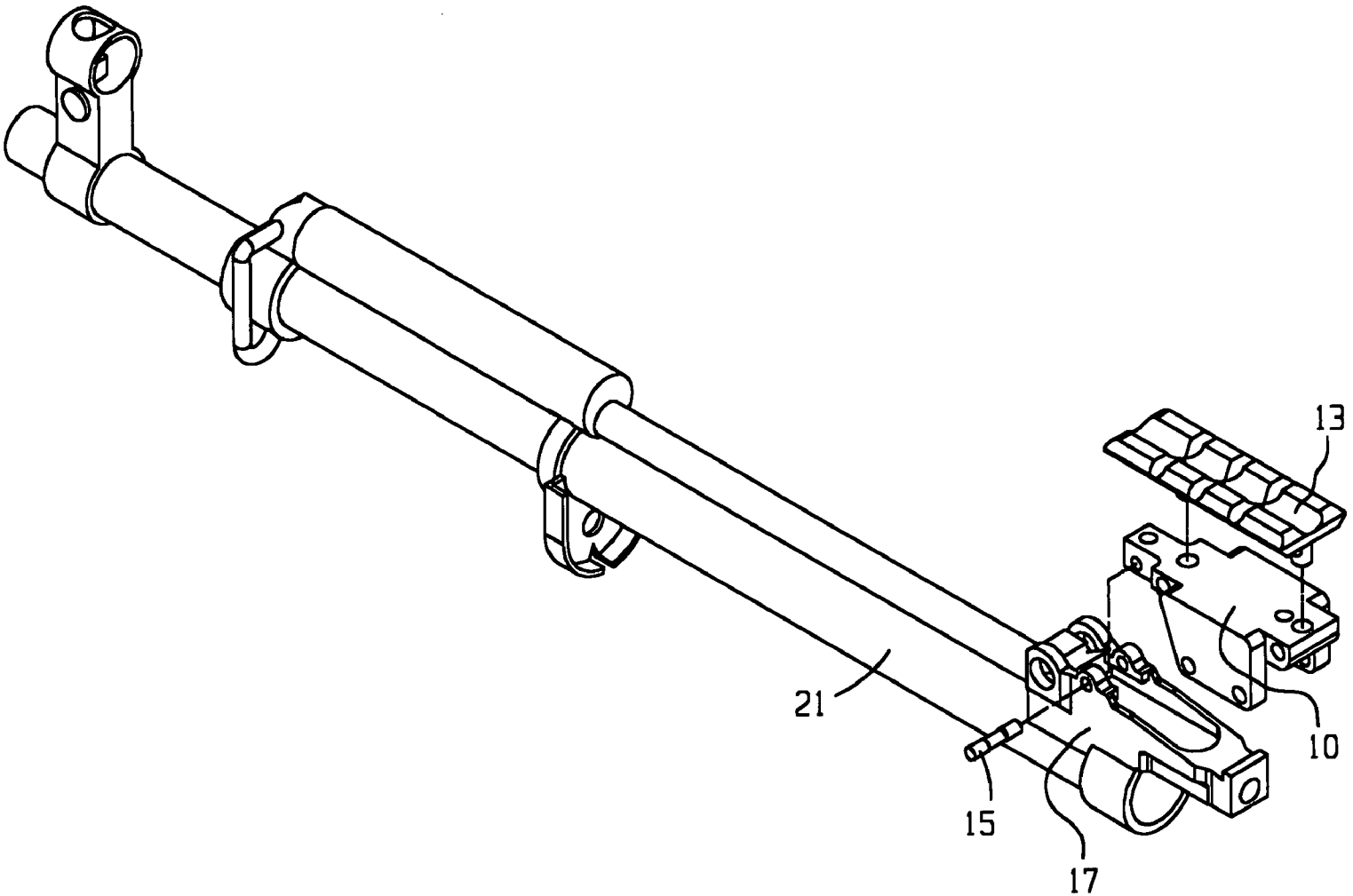
FIG. 10 shows a perspective view of a rifle barrel which is fitted with a rear battle sight mount that is adapted to receive a roll pin through a bore in the rear battle sight mount.

FIG. 10 shows a perspective view of a rifle barrel 21 which is fitted with a rear battle sight mount 17 which is adapted to receive a roll pin 15 through a bore in the rear battle sight mount. Also shown is a sight base 10 according to the present invention, and a scope mount 13.

Figure 11:
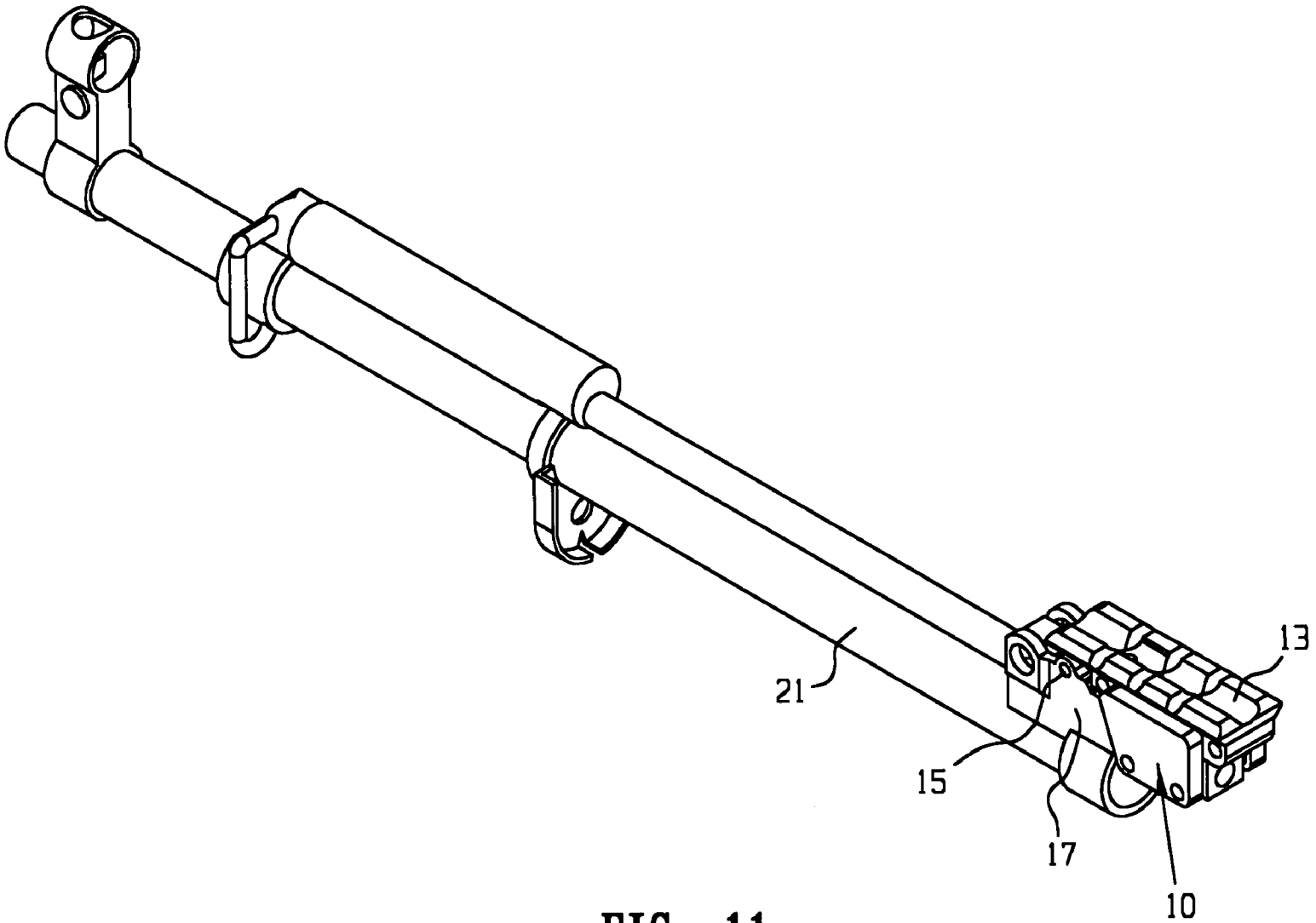
FIG. 11 shows a perspective view of a scope mount affixed to a sight base according to the invention in its assembled form, wherein the sight base is affixed to the rear battle sight mount.

In assembling a scope mounting means according to the invention for use, the scope mount 10 is first affixed to the rear battle sight mount 17 present on an existing rifle (such as that rifle known in the art as the SKS rifle) by means of a roll pin 15 caused to be commonly disposed through the roll pin receiver 33 (shown in FIG. 2) and the roll pin receiving bosses on the rear battle sight mount 17 by pressing the roll pin into place, as the use of roll pins and other functionally equivalent fastening means are well known in the art. Once the roll pin is in place, as shown in FIG. 11, a set screw disposed in the elevation adjustment bore 35 is adjusted so that the height of the rear portion of the central portion 12 near the elevation adjustment bore 35 is at a desired height, the whole sight base being pivotally disposed with respect to the rear battle sight 17 at and by means of the roll pin 15. Adjustment of a set screw within the bore 35 clockwise, when right hand threads are employed, causes the set screw to protrude from the bottom of the central portion 12 in an amount readily selectable by the user by virtue of turning of the set screw, and to selectively contact either the rifle barrel or the rear battle sight mount 17 in its protrusion, depending upon the rifle selected and the configuration of its rear battle sight mount, to adjust the height of the rear portion of the sight base 10.

Once a the desired setting of the set screw disposed within the bore 35 has been achieved, set screws disposed in the four holes 18R and 18L are turned into their bores until they snugly grip the sides of either the barrel of the rifle, or the rear battle sight mount 17, depending upon the rifle selected. Depending upon the clearance between the roll pin 15 and the roll pin receiver, an optional set screw may be inserted into the threaded hole 42 to contact the roll pin upon sufficient tightening, for increased overall positional stability. Thus, according to the foregoing, a sight base according to the invention is adapted to an existing battle sight mount 17 of an existing rifle, such as an SKS rifle.

Next, a conventional rifle scope having conventional mounting means is affixed to the scope mount 13, as such fastening of rifle scopes to such mounts as the scope mount 13 is well known in the art. Then, the protruding pins 50 and 51 protruding from the bottom surface of the scope mount 13 are inserted into the front scope mount receiving hole 25 and the rear scope mount receiving hole 27. The assembly comprising the rifle scope and scope mount 13 are next secured to the sight base 10 by tightening set screws disposed within the threaded lock bores 29, 30, 31, and 32, to provide mounting of the scope to the rifle in accordance with the present invention.

FIG. 11 shows a perspective view of a scope mount 13 affixed to a sight base 10 according to the invention in its assembled form, wherein the sight base is affixed to the rear battle sight mount 17.

Thus, the present invention provides a device useful for retrofitting rifles with a scope mounting means which comprises a central portion 12 shaped substantially in the form of a rectangular solid, having a top surface, a bottom surface, a right side surface, a left side surface, a front end portion, a rear end portion, and a longest length dimension L. A device according to the invention further comprises a right wing portion 16 attached to the right side surface of the central portion 12 and extending below said bottom surface of the central portion 12, wherein the right wing portion 16 comprises at least one threaded hole 18R disposed therethrough. A device according to the invention further comprises a left wing portion 14 attached to the left side surface of the central portion 12 and extending below the bottom surface of the central portion 12, wherein the left wing portion 14 comprises at least one threaded hole 18L disposed therethrough. The central portion 12 includes a first hole 25 and a second hole 27 disposed through its top surface which extend through the bottom surface, which holes are adapted to receive pins 50, 51 of a scope mount, and the front end portion of the central portion further includes a third hole 33 disposed through the right side surface which extends through to the left side surface.

In a preferred embodiment, the bores of the first and second holes disposed through the top surface of the central portion are smooth.

In another embodiment, the central portion 12 further includes a third hole 35 disposed through its top surface which extends through the bottom surface, which third hole 35 includes threads on its inner surface. The third hole 35 is preferably disposed between the first hole 25 and the second hole 27 disposed through the top surface of the central portion 12.

In another embodiment, the central portion 12 further includes a first hole 29 and second hole 31 disposed through the left side surface, each having centerlines that are perpendicular, respectively, to the first hole 25 and the second hole 27 disposed through the central portion 12, and wherein the first hole 29 and the second hole 31 through the left side surface each intersect with the first hole 25 and second hole 27 disposed through said top surface of the central portion 12. In another embodiment, the central portion further includes a first hole 30 and second hole 32 disposed through the right side surface, each having a centerline perpendicular, respectively, to the first hole 25 and the second hole 27 disposed through the central portion 12, and the first hole 30 and the second hole 32 through the right surface each intersect with the first hole 25 and second hole 27 disposed through the top surface of the central portion. In another embodiment, there is a fourth hole 42 disposed through the top surface of the central portion 12 at the front end portion 69, wherein the fourth hole 42 extends through to the bottom surface, and wherein the fourth hole 42 includes threads on its inner surface. The fourth hole 42 intersects with the third hole 33 disposed through the right side surface which extends through to the left side surface of the central portion 12 at its front end portion 69. In another embodiment, the threaded hole(s) 18R disposed through the right wing portion include a set screw(s) disposed therein. In another embodiment, the one threaded hole(s) 18L disposed through the left wing portion includes a set screw disposed therein. In another embodiment, the third hole 35 includes a set screw disposed therein, wherein the set screw protrudes from the bottom surface of the central portion 12, to enable height adjustment of the sight base according to the invention on a rifle to which it is affixed.

The invention further includes a rifle, not shown in the drawings, but well known to mankind, wherein the rifle comprises a rear sight mount 17 to which a sight base 10 according the invention is affixed by virtue of a fastener 15 commonly disposed through the rear sight mount 17 and the third hole 33 disposed through the right side surface of a device 10 according to the invention. Preferably, a scope mount 13 is attached to the sight base 10 by way of the protruding pins on the scope mount being inserted into the holes 25, 27 on the sight base having smooth inner bores. It is preferred that the scope mount includes a telescopic or red dot scope attached thereto, to enable a user to enjoy the benefits provided by the present invention.

A sight base according to the invention is preferably made from a single billet of metal, such as aluminum, using computerized machining techniques. According to an alternate form of the invention, a sight base as provided herein may be comprised of three pieces, the central portion 12, right wing 16, and left wing 14, which are subsequently joined using conventional fastening means such as welds, or fasteners known in the art.

While reference has been made throughout this specification to the rifle commonly referred to as the SKS rifle, the device according to the present invention is not limited in its use to this particular rifle, and may be accommodated to a large number of different rifles currently in existence. Examples of other rifles which the instant invention is useful for include, without limitation, the AK-47, 1903 A1 Springfield and the 98 Mauser.

Consideration must be given to the fact that although this invention has been described and disclosed in relation to certain preferred embodiments, obvious equivalent modifications and alterations thereof will become apparent to one of ordinary skill in this art upon reading and understanding this specification and the claims appended hereto. Accordingly, the presently disclosed invention is intended to cover all such modifications and alterations, and is limited only by the scope of the claims which follow.

I claim:

1. A device useful for retrofitting rifles with a scope mounting means which comprises:

a) a central portion shaped substantially in the form of a rectangular solid, having a top surface, a bottom surface, a right side surface, a left side surface, a front end portion, a rear end portion, and a longest length dimension;

b) a right wing portion attached to said right side surface of said central portion and extending below said bottom surface of said central portion, wherein said right wing portion comprises at least one threaded hole disposed therethrough;

c) a left wing portion attached to said left side surface of said central portion and extending below said bottom surface of said central portion, wherein said left wing portion comprises at least one threaded hole disposed therethrough;

wherein said central portion includes a first scope mount receiving hole and a second scope mount receiving hole disposed through its top surface which extend through said bottom surface, which scope mount receiving holes are adapted to receive pins of a scope mount, and wherein said front end portion of said central portion further includes a roll pin receiver hole disposed through said right side surface which extends through to said left side surface, wherein said central portion further includes a left front scope mount lock bore and a left rear scope mount lock bore disposed through said left side surface, each having a centerline perpendicular, respectively, to said first and said second scope mount receiving holes disposed through said central portion, and wherein said left front scope mount lock bore and left rear scope mount lock bore through said left side surface each intersect with said scope mount receiving holes disposed through said top surface of said central portion.

2. A device useful for retrofitting rifles with a scope mounting means which comprises:

a) a central portion shaped substantially in the form of a rectangular solid, having a top surface, a bottom surface, a right side surface, a left side surface, a front end portion, a rear end portion, and a longest length dimension;

b) a right wing portion attached to said right side surface of said central portion and extending below said bottom surface of said central portion, wherein said right wing portion comprises at least one threaded hole disposed therethrough;

c) a left wing portion attached to said left side surface of said central portion and extending below said bottom surface of said central portion, wherein said left wing portion comprises at least one threaded hole disposed therethrough;

wherein said central portion includes a first scope mount receiving hole and a second scope mount receiving hole disposed through its top surface which extend through said bottom surface, which scope mount receiving holes are adapted to receive pins of a scope mount, and wherein said front end portion of said central portion further includes a roll pin receiver hole disposed through said right side surface which extends through to said left side surface wherein said central portion further includes a right front scope mount lock bore and a right rear scope mount lock bore disposed through said right side surface, each having a centerline perpendicular, respectively, to said first and said second scope mount receiving holes disposed through said central portion, and wherein said right front scope mount lock bore and right rear scope mount lock bore through said right side surface each intersect with said scope mount receiving holes disposed through said top surface of said central portion.

3. A device useful for retrofitting rifles with a scope mounting means which comprises:

a) a central portion shaped substantially in the form of a rectangular solid, having a top surface, a bottom surface, a right side surface, a left side surface, a front end portion, a rear end portion, and a longest length dimension;

b) a right wing portion attached to said right side surface of said central portion and extending below said bottom surface of said central portion, wherein said right wing portion comprises at least one threaded hole disposed therethrough;

c) a left wing portion attached to said left side surface of said central portion and extending below said bottom surface of said central portion, wherein said left wing portion comprises at least one threaded hole disposed therethrough;

wherein said central portion includes a first scope mount receiving hole and a second scope mount receiving hole disposed through its top surface which extend through said bottom surface, which scope mount receiving holes are adapted to receive pins of a scope mount, and wherein said front end portion of said central portion further includes a roll pin receiver hole disposed through said right side surface which extends through to said left side surface, wherein said central portion further includes a left front scope mount lock bore and a left rear scope mount lock bore disposed through said left side surface, each having a centerline perpendicular, respectively, to said first and said second scope mount receiving holes disposed through said central portion, and wherein said left front scope mount lock bore and left rear scope mount lock bore through said left side surface each intersect with said scope mount receiving holes disposed through said top surface of said central portion, and wherein said central portion further includes a right front scope mount lock bore and a right rear scope mount lock bore disposed through said right side surface, each having a centerline perpendicular, respectively, to said first and said second scope mount receiving holes disposed through said central portion, and wherein said right front scope mount lock bore and right rear scope mount lock bore through said right side surface each intersect with said scope mount receiving holes disposed through said top surface of said central portion.

* * * * *